US006149459A

United States Patent [19]

Yang

[11] Patent Number: 6,149,459

[45] Date of Patent: Nov. 21, 2000

[54] STACKED ELECTRICAL CONNECTOR ASSEMBLY

[75] Inventor: Fu-Ken Yang, Taipei, Taiwan

[73] Assignee: Hon Hai Precision Ind. Co., Ltd., Taipei Hsien, Taiwan

[21] Appl. No.: 09/457,933

[22] Filed: Dec. 8, 1999

[30] Foreign Application Priority Data

Nov. 1, 1999 [TW] Taiwan ..... 88219096

[51] Int. Cl.[7] ..... H01R 13/514

[52] U.S. Cl. ..... 439/541.5

[58] Field of Search ..... 439/541.5, 701

[56] References Cited

U.S. PATENT DOCUMENTS

| | | | |
|---|---|---|---|
| 5,419,720 | 5/1995 | Chen | 439/701 X |
| 5,709,554 | 1/1998 | Savage, Jr. | 439/541.5 X |
| 6,019,631 | 2/2000 | Chen | 439/541.5 |

*Primary Examiner*—Renee Luebke
*Attorney, Agent, or Firm*—Wei Te Chung

[57] ABSTRACT

A stacked electrical connector assembly of the present invention comprises a first connector having a first housing receiving a plurality of contacts therein, a second connector having a second housing securely engaged to the top of the first housing and having an insert block being received in the second housing, a front shell having a panel defining an upper opening and a lower opening for complementary connectors to extend therethrough, and a rear shell comprising a back plate and a top plate, which locks to the front shell. The first housing includes a base having a plurality of passageways in the configuration of a MINI DIN connector. The second housing has a baffle depending from its lower side and defining a plurality of second grooves therein. The insert block defines a through-hole in a rear side which accommodates a conversion device, and a mating cavity in a front side which accommodates a fiber optic mating connector. Several terminals depending from a lower side of the conversion device are received in the second grooves of the baffle. A dust-preventing plate pivotably mounted at a front of the second housing prevents entrance of dust particles into the mating cavity of the second connector when not connected to a fiber optic mating connector.

9 Claims, 5 Drawing Sheets

STACKED ELECTRICAL CONNECTOR ASSEMBLY

BACKGROUND OF THE INVENTION

The present invention relates to a stacked electrical connector assembly, and particularly to a stacked electrical connector assembly having a dust-proof housing.

Certain devices require both a FIBER OPTIC connector and MINI DIN connector. U.S. Pat. No. 5,909,526 and Taiwan patent application No.80208342, disclose individual arrangements of the two connectors mounted on a printed circuit board, however, these arrangements require a relatively large area on said printed circuit board, which is a disadvantage. Moreover, in existing FIBER OPTIC connectors, the opening for engaging with a mating connector provides dust with an easy entrance to the inner space of the FIBER OPTIC connector, thereby affecting the electrical connection between the connector and a mating connector. Hence, an improved stacked electrical connector assembly with a MINI DIN connector and a FIBER OPTIC connector is required to overcome the disadvantages of the prior art.

BRIEF SUMMARY OF THE INVENTION

A first object of the present invention is to provide a stacked electrical connector assembly for saving mounting space on a printed circuit board.

A second object of the present invention is to provide a stacked electrical connector assembly having a dust-preventing housing.

Accordingly, a stacked electrical connector assembly in accordance with the present invention comprises a first connector having a first housing receiving a plurality of contacts therein, a second connector having a second housing securely engaged to the top of the first housing and having an insert block being received in the second housing, a front shell having a panel defining an upper opening and a lower opening for complementary connectors to extend therethrough, and a rear shell comprising a back plate and a top plate, which locks to the front shell. The first housing includes a base having a plurality of passageways in the configuration of a MINI DIN connector. The second housing has a baffle depending from its lower side and defining a plurality of second grooves therein. The insert block defines a through-hole in a rear side which accommodates a conversion device, and a mating cavity in a front side which accommodates a fiber optic mating connector. Several terminals depending from a lower side of the conversion device are received in the second grooves of the baffle. A dust-preventing plate pivotably mounted at a front of the second housing prevents entrance of dust particles into the mating cavity of the second connector when not connected to a fiber optic mating connector.

Other objects, advantages and novel features of the invention will become more apparent from the following detailed description of the present embodiment when taken in conjunction with the accompanying drawings.

DETAILED DESCRIPTION OF THE INVENTION

Figure 1:
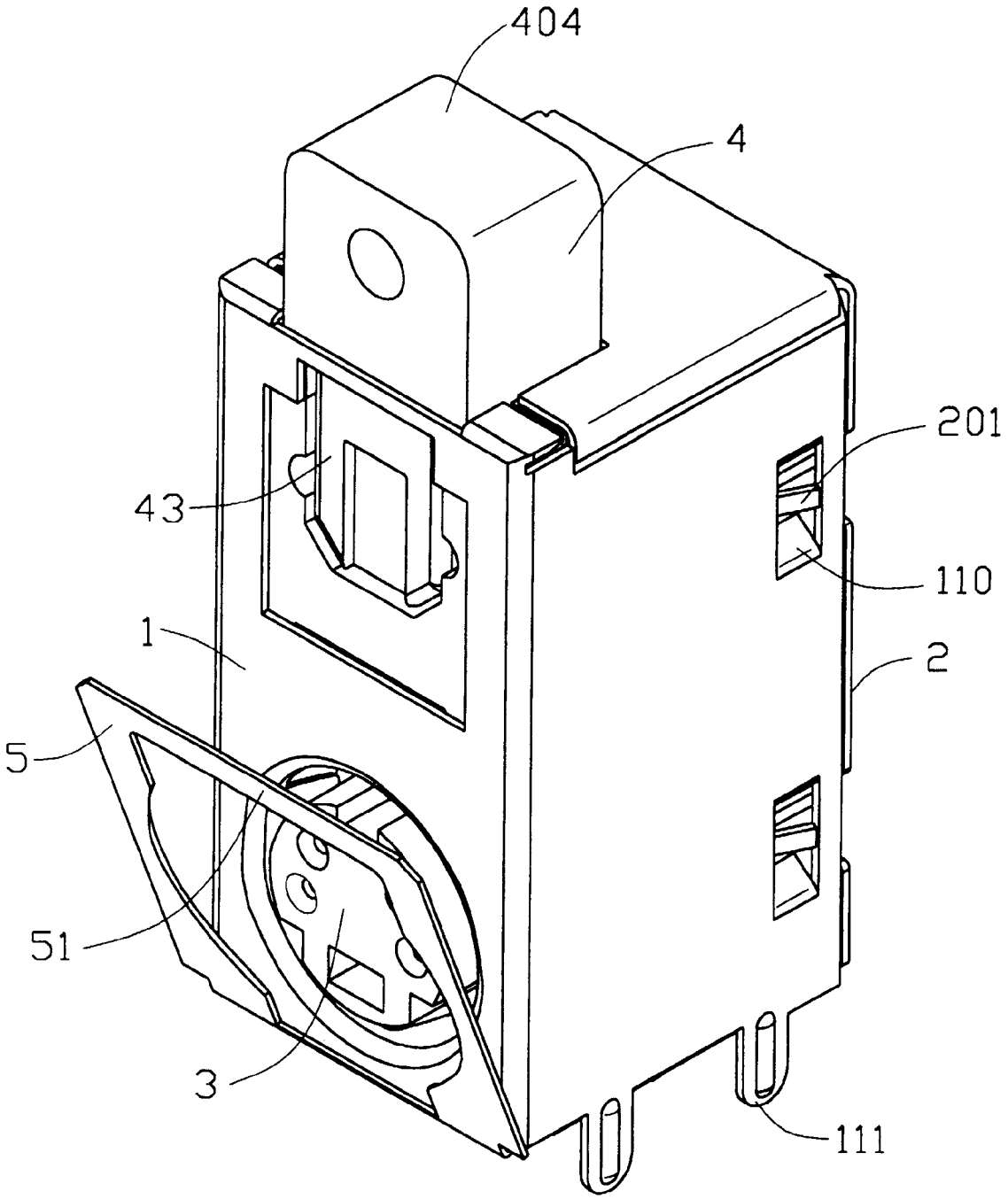
FIG. 1 is an assembled view of a stacked electrical connector assembly in accordance with the present invention.
Figure 2:
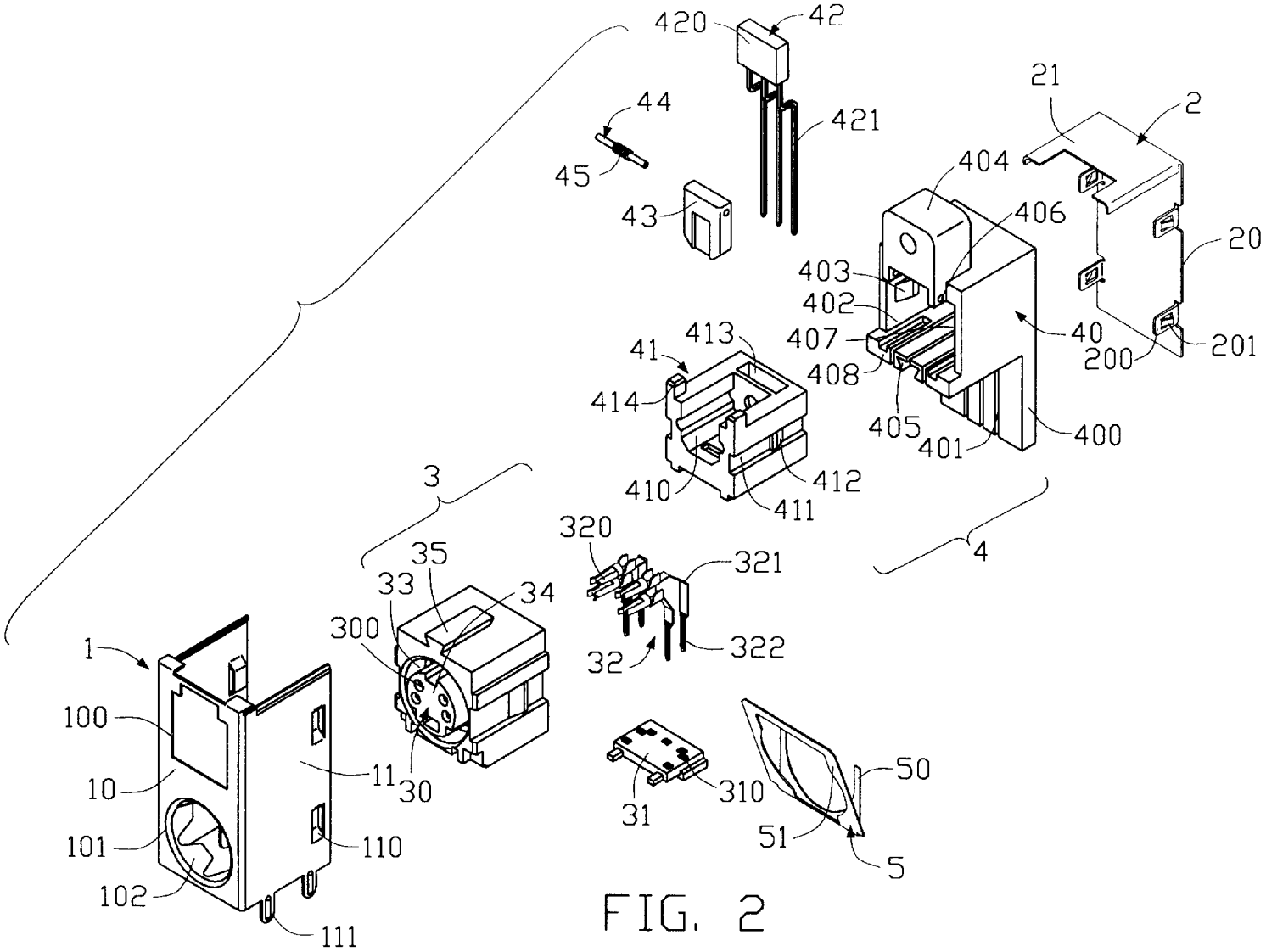
FIG. 2 is an exploded view of a stacked electrical connector assembly in accordance with the present invention.

Referring to FIGS. 1–2, a stacked electrical connector assembly in accordance with the present invention comprises the combination of a front shell 1, a rear shell 2 with a back plate 20, a first connector 3, a second connector 4, and a grounding plate 5.

The front shell 1 comprises a panel 10 with an upper opening 100 and a lower opening 101 for complementary first and second mating connectors to extend therethrough. A contacting portion 102 extends from an inner edge of the lower opening 101 into an interior (not labeled) of the front shell 1. A pair of side plates 11 extend from opposite sides of the panel 10, each defining a pair of indentations 110 at a rear side thereof and a pair of tangs 111 at a lower side thereof for engaging with a printed circuit board (not shown).

A top plate 21 extends forward from the back plate 20 of the rear shell 2, and a pair of latches 200 is formed at each side of the back plate 20, a clip portion 201 being formed thereon for engaging with the indentation 110 of the front shell 1. The grounding plate 5 is positioned between the front shell 1 and the first housing 30. A mating portion 50 is mounted between said panel 10 of said front shell 1 and the first connector 3, and a grounding portion 51 is positioned outside the front shell 1 for engaging with a complementary connector 6 (see FIG. 5).

Figure 4:
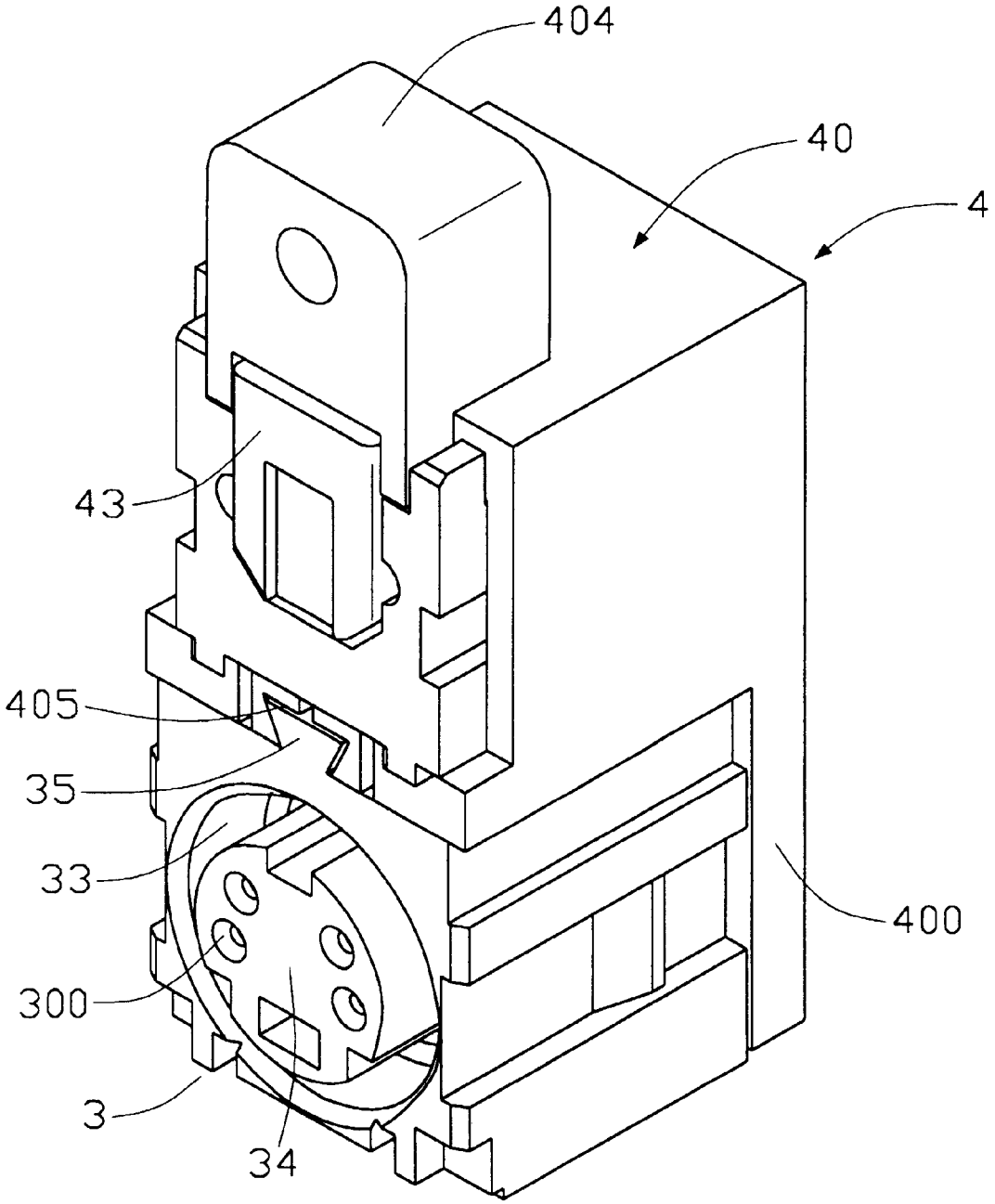
FIG. 4 is a perspective view of the first connector and the second connector assembled together in accordance with the present invention.

Referring to FIGS. 2 and 4, the first connector 3 is a MINI DIN connector. The first connector 3 comprises a first housing 30 receiving a plurality of contacts 32 therein and having a spacer 31 located beneath the first housing 30 when assembled. The first housing 30 forms a base 34 defining a plurality of passageways 300 for receiving the corresponding plurality of contacts 32 therein, and a channel 33 defined between the sides of the base 34 and an outer shell (not labeled) of the first housing 30. A rib 35 is formed on a top surface (not labeled) of the first housing 30. A plurality of holes 310 is defined through the spacer 31 for receiving corresponding contacts 32 extended therethrough.

Each contact 32 includes a horizontally extending contact section 320 at one end, a vertically extending soldering tail 322 at an opposite end and a pliant section 321 between the contact section 320 and the soldering tail 322. The contact sections 320 are received in the passageways 300 of the base 34, and the soldering tails 322 extend through the holes 310 of the spacer 31.

Figure 3:
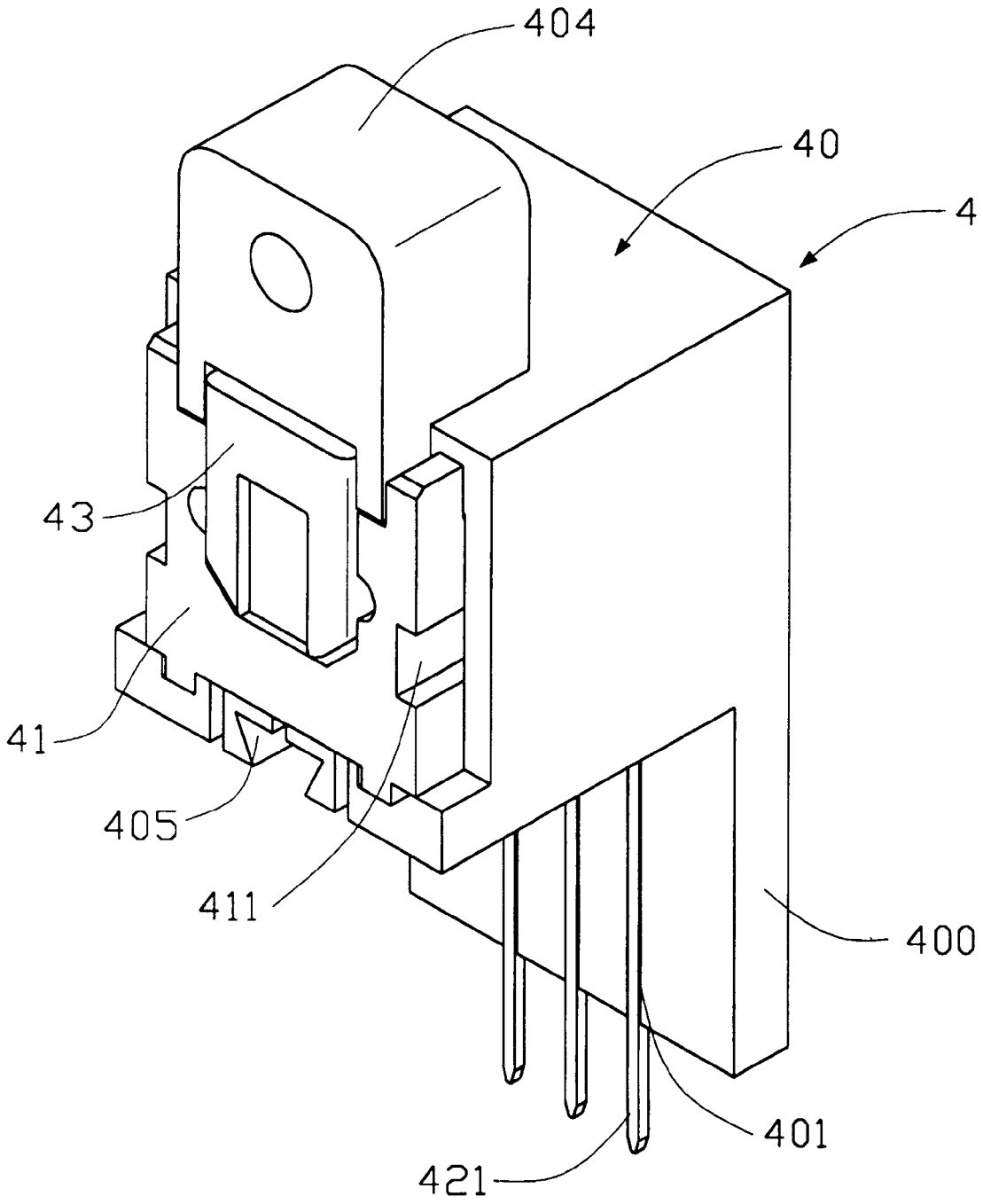
FIG. 3 is a perspective view of the second connector in accordance with the present invention.

Referring to FIGS. 2–3, the second connector 4 is a FIBER OPTIC connector comprising a second housing 40, an insert block 41, a conversion device 42 and a dust-preventing plate 43. The second housing 40 comprises a horizontally formed platform plate 408, a pair of opposing side walls (not labeled) upwardly extending from opposite sides of platform plate 408, a rear wall (not shown) upwardly extending from a rear side of platform plate 408, and a top wall (not labeled) horizontally extending between upper edges of the opposing side walls (not labeled) and rear wall (not shown). A rectangular receiving cavity 402 is defined interior to the platform plate 408, the opposing side walls (not labeled), the rear wall (not shown) and the top wall (not labeled). Oppositely, a space (not labeled) is formed below the platform plate 408 for receiving the first housing 30 therein. A top projection 404 extends upwardly from a top of the second housing 40 and a baffle 400 depends downwardly from a rear of the second housing 40. A plurality of first grooves 407 extend along the platform plate 408 and a plurality of second grooves 401 is defined in the baffle 400. A pair of inner projections 403 symmetrically protrude from opposite inner surfaces of the opposing side walls (not labeled). A dove-tailed slot 405 is defined in a lower face not labeled) of the platform plate 408 for engaging with the rib 35 of the first housing 30.

The insert block 41 is received in the receiving cavity 402 and defines a mating cavity 410 for insertion of a fiber optic mating connector 6. A through-hole 413 is defined through the insert block 41 to a rear of the mating cavity 410 for disposing the conversion device 42. The conversion device 42 includes a conversion element 420 and several terminals 421 depending downward from the conversion element 420. During assembling, the terminals 421 receivably move along the first grooves 407 of the platform plate 408 and then are embedded within the second grooves 401 of the baffle 400.

A pair of slots 411 is defined in opposite sides of the insert block 41, each including a ramp 412 formed therein to engage with inner projections 403 of the receiving cavity 402. Moreover, two ridges 414 are positioned on the top of the insert block 41 for abutting the sides of the top projection 404.

Figure 5:
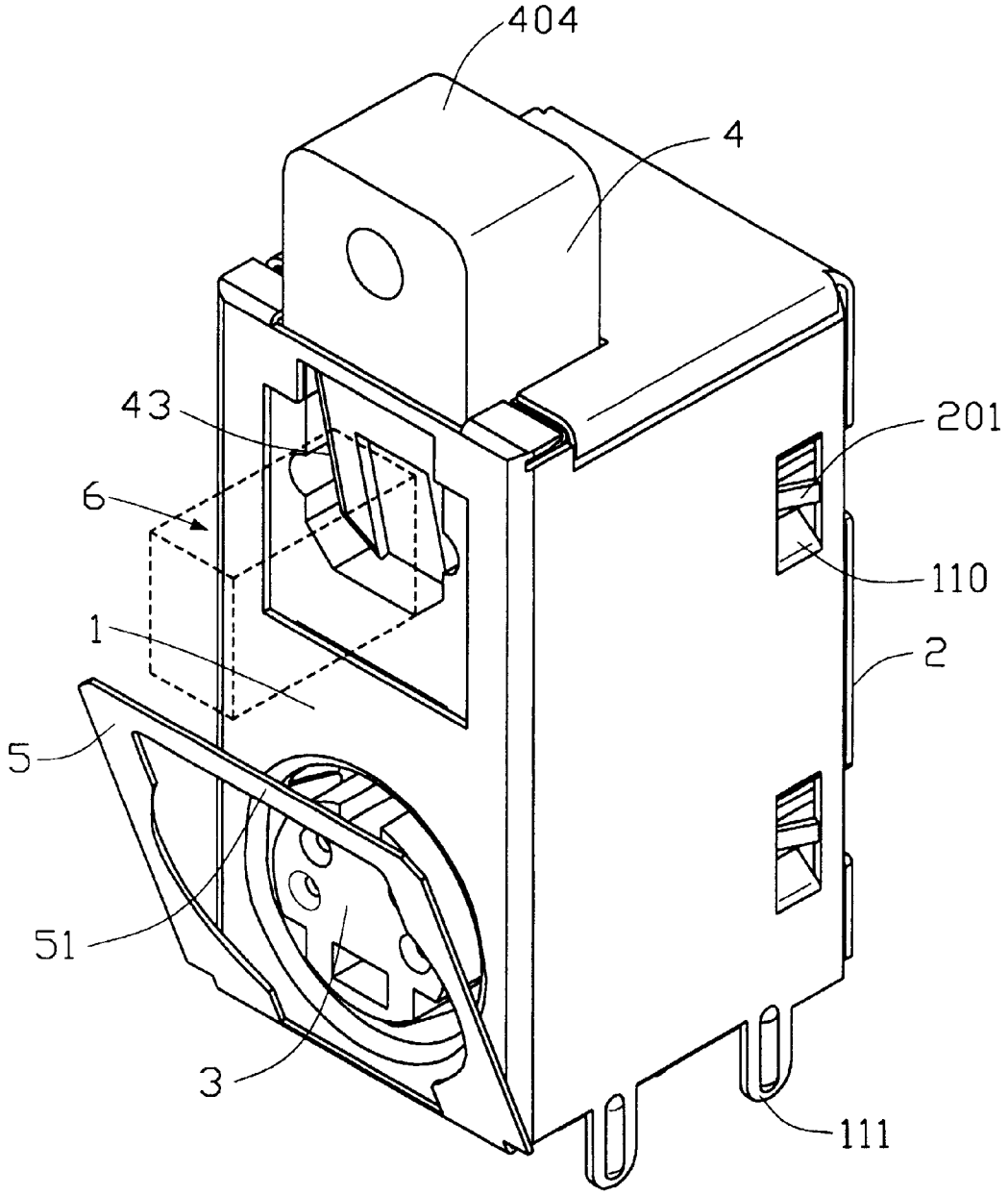
FIG. 5 is a perspective view of the assembled connector showing the pivoting relationship of the dust-preventing plate with the stacked electrical connector assembly and a complementary fiber optic mating connector being inserted into the second connector thereof.

Referring to FIG. 2, a pair of pivot holes 406 is defined in the sides of the top projection 404 for engaging with a pivot 44 and a spring element 45. The dust-preventing plate 43 is positioned at the front of the spring element 45. Referring to FIG. 5, in assembly, the two ends of the pivot 44 are located in the pivot holes 406, the spring element 45 engages with a rear surface of the dust-preventing plate 43, and the dust-preventing plate 43 pivots about the pivot 44, allowing entrance of the fiber optic mating connector 6 to extend therethrough. The purpose of the dust-preventing plate 43 is to prevent dust from entering the mating cavity 410 when no mating fiber optic connector is present.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A stacked electrical connector assembly comprising:

a first connector having a first housing and a plurality of contacts received in the first housing, the first housing including a base having a plurality of passageways for receipt of contact sections of the plurality of contacts therein;

a second connector securely stacked on a top of the first connector, the second connector having a second housing defining a receiving cavity and a baffle, an insert block accommodated in the receiving cavity, a conversion device received in the insert block, and a dust-preventing plate pivotably mounted at a front of the second housing, the receiving cavity including a plurality of first grooves, the baffle having a plurality of second grooves, the conversion device comprising a plurality of terminals received in the first grooves and the second grooves;

a front shell having a panel and defining an upper opening and a lower opening for complementary first and second connectors to extend therethrough; and a rear shell defining a back plate and a top plate, the back plate being locked to the front shell.

2. The stacked electrical connector assembly as claimed in claim 1, wherein a top projection extends from a top of the second housing and has a pivot hole therein.

3. The stacked electrical connector assembly as claimed in claim 1, further comprising a spacer positioned below the first housing, a plurality of holes being provided through the spacer for soldering tails of the corresponding contacts to extend therethrough.

4. The stacked electrical connector assembly as claimed in claim 1, wherein a rib is located at a top of the first housing, the second housing comprises a platform plate, and a dove-tailed slot is formed at a bottom of the platform plate for receiving the rib.

5. The stacked electrical connector assembly as claimed in claim 1, wherein the baffle depends from a rear bottom of the second housing.

6. A stacked connector assembly comprising:

a first connector defining a first housing with a plurality of first contacts therein; and a second connector defining a second housing positioned atop the first housing, said second housing defining a receiving cavity above a platform plate thereof, an insert block receiveably assembled in the receiving cavity and cooperating with the first housing to sandwich the platform plate therebetween, an electronic device disposed in the insert block with a plurality of second contacts downwardly extending therefrom; wherein said platform plate defines a plurality of grooves therealong in a front-to-back direction so as to allow the second terminals to move along the corresponding grooves and extend through the platform plate in a vertical direction, respectively, when said insert block is inserted into the receiving cavity and before the first housing is assembled to the second housing.

7. The assembly as claimed in claim 6, further including means for combining the first housing and the second housing together without separation in a vertical direction.

8. The assembly as claimed in claim 6, further including means for combining the insert block to the first housing with separation in back-and-forth directions.

9. A method of assembling a stacked connector assembly, comprising the steps of:

providing a first connector with a first housing and a plurality of first contacts therein;

providing a second connector with a second housing, said second housing including a platform plate with a receiving cavity thereabove and a space thereunder;

forming a plurality of grooves in and along the platform plate;

providing an electronic device with a plurality of second contacts extending downward therefrom;

inserting an insert block into the receiving cavity, in a front-to-back direction of the second housing, with a plurality of second terminals moving along the plurality of grooves and extending through and out of the platform plate in a vertical direction, respectively, until the insert block reaches a final horizontal position within the receiving cavity; and assembling the first housing into the space in the second housing in the same front-to-back direction after the insert block has been fully assembled to the second housing wherein the second terminals are sandwiched between a first rear section of the first housing and a second rear section of the second housing.

* * * * *